US009201338B2

(12) United States Patent
Kubo et al.

(10) Patent No.: US 9,201,338 B2
(45) Date of Patent: Dec. 1, 2015

(54) IMAGE FORMING APPARATUS, NON-TRANSITORY COMPUTER READABLE MEDIUM, AND IMAGE FORMING METHOD

(71) Applicant: FUJI XEROX CO., LTD., Tokyo (JP)

(72) Inventors: Masahiko Kubo, Kanagawa (JP); Jun Koyatsu, Kanagawa (JP); Keiichi Okada, Kanagawa (JP); Yosuke Tashiro, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/333,995

(22) Filed: Jul. 17, 2014

(65) Prior Publication Data

US 2015/0117875 A1 Apr. 30, 2015

(30) Foreign Application Priority Data

Oct. 30, 2013 (JP) ..... 2013-225227

(51) Int. Cl.

| | |
|---|---|
| ***G03G 15/00*** | (2006.01) |
| ***G03G 15/01*** | (2006.01) |
| ***G03G 15/08*** | (2006.01) |

(52) U.S. Cl.
CPC ..... *G03G 15/0848* (2013.01); *G03G 15/01* (2013.01); *G03G 15/0121* (2013.01)

(58) Field of Classification Search
CPC ..... G03G 15/5029; G03G 15/0848; G03G 15/0121; G03G 15/01
USPC ..... 399/15, 45, 49, 389, 53, 54
See application file for complete search history.

(56) References Cited

U.S. PATENT DOCUMENTS

2005/0058465 A1* 3/2005 Toyohara ..... 399/45

FOREIGN PATENT DOCUMENTS

| | | |
|---|---|---|
| JP | A-62-067558 | 3/1987 |
| JP | A-2006-050347 | 2/2006 |

* cited by examiner

*Primary Examiner* — Hoang Ngo
(74) *Attorney, Agent, or Firm* — Oliff PLC

(57) ABSTRACT

An image forming apparatus includes an image forming unit and a controller. The image forming unit forms an image on each medium with a metallic toner. The controller controls the image forming unit such that, in the formation of an image on each medium of plural media different in reflectance, the metallic toner has a toner weight according to the medium.

11 Claims, 6 Drawing Sheets

IMAGE FORMING APPARATUS, NON-TRANSITORY COMPUTER READABLE MEDIUM, AND IMAGE FORMING METHOD

CROSS-REFERENCE TO RELATED APPLICATIONS

This application is based on and claims priority under 35 USC 119 from Japanese Patent Application Ho. 2013-225227 filed Oct. 30, 2013.

BACKGROUND

1. Technical Field

The present invention relates to an image forming apparatus, a non-transitory computer readable medium, and an image forming method.

2. Summary

According to an aspect of the invention, there is provided an image forming apparatus including an image forming unit and a controller. The image forming unit forms an image on a medium with a metallic toner. The controller controls the image forming unit such that, in the formation of an image on each medium of plural media different in reflectance, the metallic toner has a toner weight according to the medium.

BRIEF DESCRIPTION OF THE DRAWINGS

An exemplary embodiment of the present invention will foe described in detail based, on the following figures, wherein.

DETAILED DESCRIPTION

Figure 1:
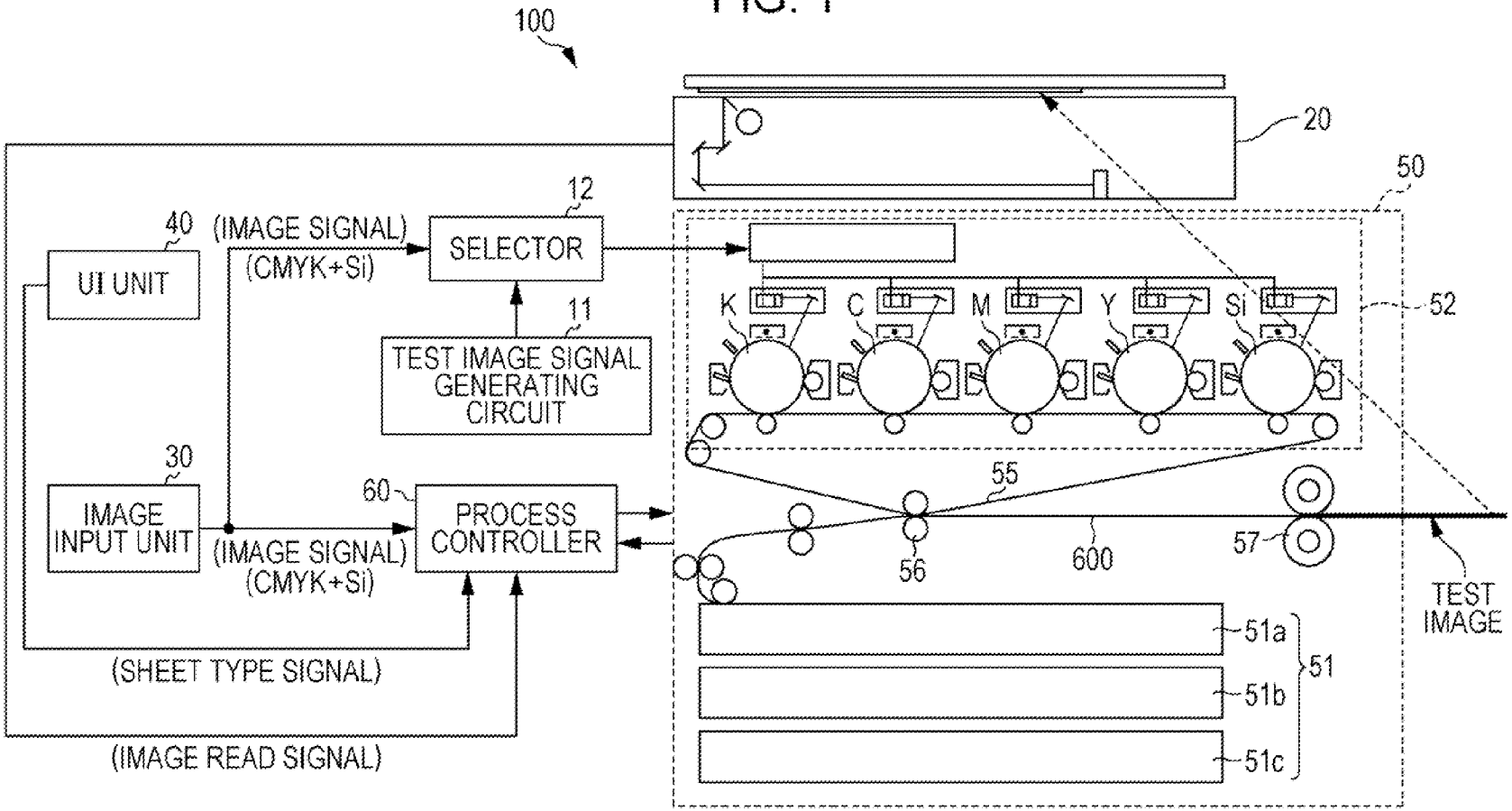
FIG. 1 is a diagram illustrating an overall configuration of an image forming apparatus in an exemplary embodiment of the present invention.

FIG. 1 is a diagram, illustrating an overall configuration of an image forming apparatus 100 in an exemplary embodiment of the present invention. The image forming apparatus 100 includes a test image signal generating circuit 11, a selector 12*f* an image reading unit 20, an image input unit 30, a user interface (UT) unit 40, an image forming unit 50, and a process controller 60.

The test image signal generating circuit 11 stores data for generating a test image signal representing a predetermined test image, for example, and supplies the generated test image signal to the selector 12. The test image will foe described in detail later (see FIG. 6). The selector 12 selects one of the test image signal acquired from the test image signal generating circuit 11 and an image signal acquired from, the image input unit 30, and outputs the selected image signal to the image forming unit 50. The selector 12 outputs the image signal as the basis of a toner image to be formed by the image forming unit 50.

The image reading unit 20 is a so-called scanner including light sources, imaging lenses, a line sensor, and so forth, which are not illustrated. The light sources radiate light onto an imaging target, such as a document. The imaging lenses image reflected light from the imaging target at the position of the line sensor. The line sensor receives the imaged light, and generates and outputs an image signal according to the light. The line sensor, which includes imaging devices capable of imaging with three colors of red (R), green (G), and blue (B), for example, generates the image signal of the three colors. Then, the image reading unit 20 performs analog-to-digital (A/D) conversion processing on the above-described image signal, and outputs the processed signal to the process controller 60 as a rear signal.

The image input unit 30 receives an image signal provided by a not-illustrated external apparatus such as a computer via a network such as a local area network (LAN), for example, to form an image. Thereby, the image signal is input to the image forming apparatus 100. The image signal corresponds to the colors of the toner image to foe formed by the image forming unit 50, and includes gradation values of respective pixels divided into four color components of cyan (C), magenta (M), yellow (Y), and black (K). The image signal further includes a silver (Si) component corresponding to a silver toner, which is a metallic toner.

The metallic toner is a toner for adding a metallic look to the toner image printed on a medium, such as paper. As the metallic toner used in the image forming apparatus 100 in FIG. 1, a silver toner using aluminum, powder or a gold toner using brass powder, for example, is favorable. Of course, a metallic toner using powder of another metal, for example, may also foe used. In addition to the metal powder, a color pigment may also be mixed in the metallic toner to add a hue.

The UI unit 40 is a user interface, such as a touch panel, which receives an operation input by a user and is capable of notifying the user of information including displaying information to the user. The image forming apparatus 100 in FIG. 1 is capable of forming an image on a color recording sheet, such as a black recording sheet (a black sheet), as well as on a white recording sheet (a white sheet). When the user operates the UI unit 40 to specify the type of the recording sheet (recording medium) on which the image is to be formed, the UI unit 40 outputs a sheet type signal representing the type (color, for example) of the recording sheet to the process controller 60.

The image forming unit 50, which forms on the recording sheet the image according to the image signal obtained from the selector 12, includes a sheet feed tray 51, an image forming engine 52, an intermediate transfer belt 55, a second transfer device 56, and a fixing device 57. The sheet feed tray 51 includes sheet feed trays 51*a*, 51*b*, and 51*c* each storing plural recording sheets cut in a predetermined size, such as A4-size. The stored sheets are picked up one by one from the sheet feed tray 51 and sequentially transported on a sheet transport path 600 leading to a sheet exit port via the second transfer device 56 and the fixing device 57. For example, the sheet feed tray 51*a* stores "white sheets," the sheet feed tray 51*b* stores "black sheets," and the sheet feed tray 51*c* stores recording sheets of another color. The image forming engine 52 forms on the intermediate transfer belt 55 toner images according to the image signal corresponding to the respective colors of C, M, Y, and K and the metallic toner Si.

Figure 2:
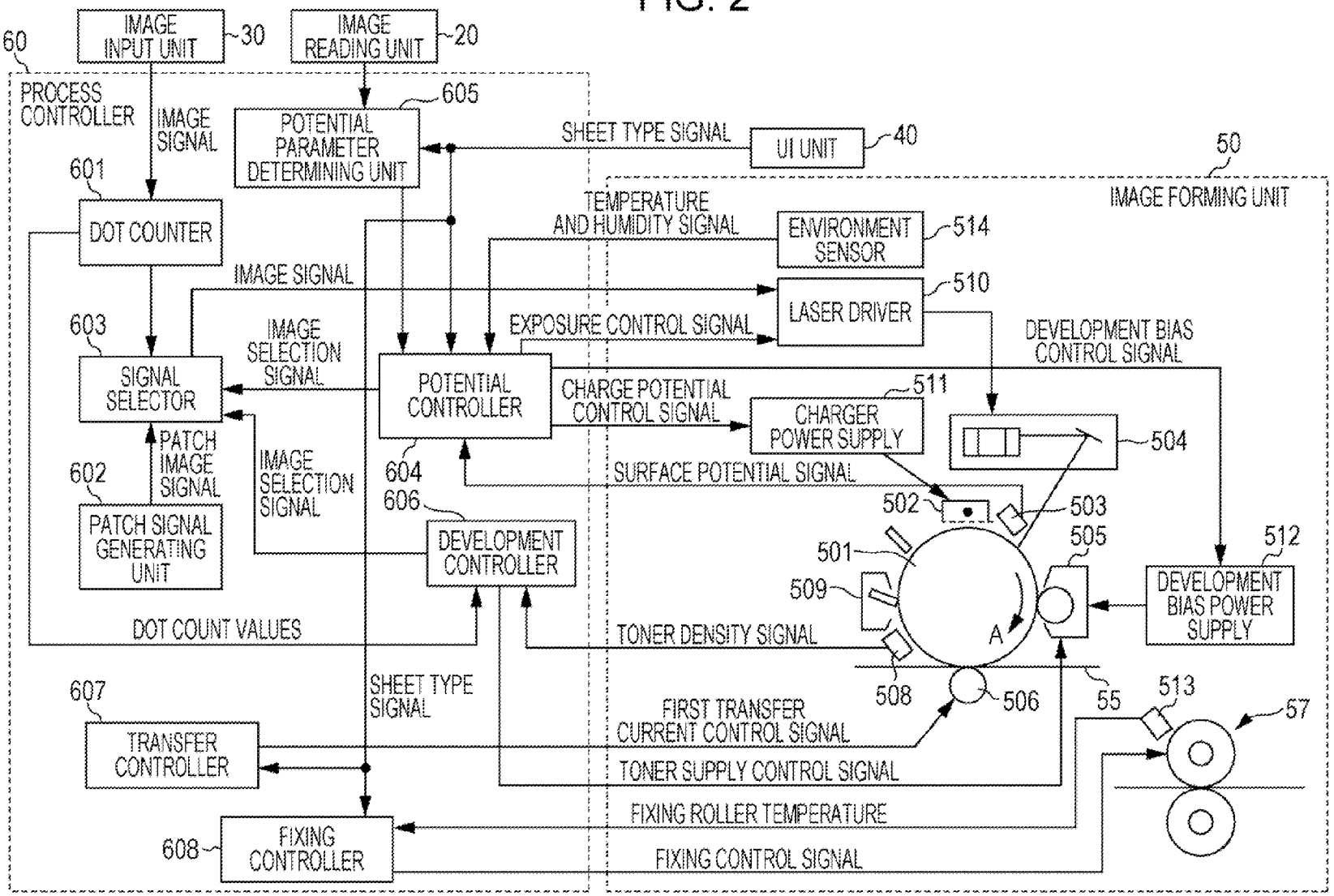
FIG. 2 is a diagram illustrating a detailed configuration of an image forming unit and a process controller.

FIG. 2 is a diagram illustrating a detailed configuration of the image forming unit 50 and the process controller 60. For the control (process control) of the drive state of the image forming unit 50, the process controller 60 determines favorable values of various physical quantities determining the drive state (hereinafter referred to as the "control parameters"). Herein, respective mechanisms included in the image forming engine 52 (FIG. 1) to form C, M, Y, K, and Si toner images are the same in basic configuration. Therefore, the following description will be given with reference to FIG. 2 illustrating only one of the mechanisms.

The image forming engine 52 includes a charger 502, a potential sensor 503, an exposing device 504, a developing device 505, a first transfer device 506, a toner density sensor 508, a cleaner 509, a laser driver 510, a charger power supply 511, a development bias power supply 512, a temperature sensor 513, and an environment sensor 514, which are disposed to surround a photoconductor drum 501 that rotates.

The photoconductor drum 501 is an image carrier having two or three photo-conductive layers formed, on a conductive substrate, for example. The photoconductive layers include a charge generating layer and a charge transporting layer formed of organic photoconductors (OPCs) and serving as charge receptors. The photoconductor drum 501 is rotated around the central axis thereof in the direction of arrow A in the drawing (clockwise direction) by a not-illustrated drive mechanism. The charger 502 is a scorotron for first charge to uniformly charge a surface of the photoconductor drum 501. The charger 502 charges the surface of the photoconductor drum 501 to a predetermined charge potential. The potential sensor 503 is a sensor that detects the surface potential of the photoconductor drum 501 at a position downstream of a charge position of the charger 502 and upstream of a development position of the developing device 505 in the direction of arrow A. The potential sensor 503 outputs a surface potential signal representing the detected, surface potential, to the process controller 60.

The exposing device 504 radiates laser light to a polygon mirror to radiate reflected light from, the polygon mirror to the surface of the photoconductor drum 501. Thereby, the surface potential of the photoconductor drum 501 is reduced to a predetermined potential by photoconductivity, and an electrostatic latent image is formed. The developing device 505 develops the electrostatic latent image with a toner (color material) contained in a developer. In this process, the developing device 505 supplies an amount of toner according to the control of the process controller 60. The scanning direction of the exposing light, which is equal to the axial direction of the photoconductor drum 501, will be referred to as the "major scanning direction" of the image forming unit 50. Further, a direction perpendicular to the major scanning direction will foe referred to as the "sub-scanning direction" of the image forming unit 50.

When the toner image formed on the surface of the photoconductor drum 501 reaches a position at which the first transfer device 506 and the photoconductor drum 501 nip the intermediate transfer belt 55 therebetween (a transfer position) in accordance with the rotation of the photoconductor drum 501, the first transfer device 506 transfers the toner image onto the intermediate transfer belt 55. Specifically, the first transfer device 506 is supplied with a first transfer current having a magnitude according to the control parameters calculated by the process controller 60. Thereby, electrostatic force is generated by the potential difference between the photoconductor drum 501 and a major roller of the first transfer device 506 charged to a potential according to the first transfer current (a transfer potential). With the action of the electrostatic force, the toner image is transferred onto the intermediate transfer belt 55.

The toner density sensor SOB radiates detection light onto the surface of the photoconductor drum 501 formed with the toner image, detects the density of the toner image in accordance with the light amount of reflected light from the surface of the photoconductor drum 501, and outputs a signal representing the detected density of the toner image. The cleaner 509 removes residual toner and paper dust on the surface of the photoconductor arum 501.

The laser driver 510 controls the intensity (exposure) of the light to foe radiated by the exposing device 504 in accordance with the control parameters calculated by the process controller 60 to form the electrostatic latent image on one surface of the photoconductor drum 501. The charger power supply 511 supplies the charger 502 with electric power for causing the charger 502 to charge the photoconductor drum 501. The development bias power supply 512 supplies the developing device 505 with electric power for causing a developing roller of the developing device 505 to apply a development bias to the photoconductor drum 501. The respective amounts of electric power supplied to the charger 502 and the developing device 505 are according to the control parameters calculated by the process controller 60.

The temperature sensor 513 is disposed around the fixing device 57, and outputs a signal representing a detected temperature to the process controller 60. The environment sensor 514 detects the temperature and humidity in the image forming apparatus 100, and outputs a temperature and humidity signal representing the detected values of the temperature and humidity to the process controller 60.

Returning to FIG. 1, when a belt surface of the intermediate transfer belt 55, on which the toner images of the respective colors and the metallic toner are formed in a superimposed manner by the image forming engine 52, and the recording sheet transported from the sheet feed tray 51 via the sheet transport path 600 reach a transfer position of the second transfer device 56, the second transfer device 56 transfers the toner images onto the recording sheet from the intermediate transfer belt 55 with the action of a major roller of the second transfer device 56.

The fixing device 57 fixes the toner images transferred to the recording sheet. Specifically, the fixing device 57 forms a contact area by having the sheet transport path 600 nipped between a circumferential surface of a heat roller including therein a heat source and a circumferential surface of a pressure roller. When the recording sheet subjected to the transfer of the toner images by the second transfer device 56 is moved to the transfer position, the fixing device 57 fixes the toner images on the recording sheet with the heating action of the heat roller and the pressing action of the pressure roller. The image forming unit 50 is configured as described above.

Returning to FIG. 2, the configuration of the process controller 60 will be described. The process controller 60 includes a dot counter 601, a patch signal generating unit 602, a signal selector 603, a potential controller 604, a potential parameter determining unit 605, a development controller 606, a transfer controller 607, and a fixing controller 608.

The dot counter 601 counts the number of dots when the exposing device 504 forms the electrostatic latent image on the surface of the photoconductor drum 501 on the basis of the linage signal acquired from the image input unit 30. The dot counter 601 outputs the counted number of dots to the development controller 606, and directly outputs the acquired image signal to the signal selector 603.

The patch signal generating unit 602 generates and outputs a predetermined image signal (hereinafter referred to as the "patch image signal") to the signal selector 603. The patch image signal is an image signal of raster data of plural rectangular images aligned in the sub-scanning direction, with the densities of the rectangular images gradually shifting from the highest density to the lowest density. The width in the major scanning direction of the rectangular images fits in a small range around a density detection, point of the toner density sensor 508.

The signal selector 603 selects one of the image signal acquired from the dot counter 601 and the patch image signal acquired from the patch signal generating unit 602, and outputs the selected image signal to the laser driver 510 of the image forming unit 50. Specifically, the signal selector 603 selects and outputs the patch image signal when having acquired a later-described image selection signal, and selects and outputs the image signal acquired from the dot counter 601 in the other cases.

The potential controller 604 controls the driving of the laser driver 510, the charger power supply 511, and the development bias power supply 512. Specifically, every time the image signal is supplied to the image forming unit 50 from the signal selector 603 and the toner image is formed, the potential controller 604 acquires the sheet type signal from the UI unit 40, the surface potential signal from the potential sensor 503, and the temperature and humidity signal from the environment sensor 514. Then, on the basis of the acquired signals, the potential controller 604 calculates the difference between the actual value and the ideal value of each of the exposure of a laser diode of the exposing device 504, the charge potential of the charger 502, and the potential of the development bias of the developing device 505. The potential controller 604 then outputs an exposure control signal, a charge potential control signal, and a development bias control signal to the laser driver 510, the charger power supply 511, and the development bias power supply 512, respectively, to drive the laser driver-510, the charger power supply 511, and the development bias power supply 512 on the basis of the control parameters for offsetting the difference.

In this process, the potential controller 604 drives the respective units with the control parameters for controlling the amount per unit area of the color material (hereinafter simply referred to as the "toner weight") of the metallic toner in accordance with the type (reflectance level) of the recording sheet identified in accordance with the sheet type signal.

The toner weight of the toner transferred to the surface of the photoconductor drum 501 from the developing device 505 in the development process is determined by the potential difference between the surface potential of the photoconductor drum 501 and the development bias of the developing device 505. A reduction of the potential difference results in a reduction of the electrostatic force and a reduction, of the toner weight. For example, if the exposure is reduced with the development bias and the charge potential kept constant, the potential is increased in the exposed area, i.e., the area of the electrostatic latent image. Therefore, the potential difference between the electrostatic latent image and the development bias is reduced, and the toner weight is also reduced. Also in a case in which the development bias is reduced with the charge potential and the exposure kept, constant, the potential difference between the development bias and the electrostatic latent image is reduced, and the toner weight is reduced. Further, if the charge potential is increased with the exposure and the development bias kept constant, the potential of the electrostatic latent image is increased accordingly. Therefore, the potential difference between the electrostatic latent image and the development bias is reduced, and the toner weight is reduced.

The toner weight of the developed image on the photoconductor drum 501 thus changes in accordance with the exposure, the charge potential, and the development bias. To form the toner image with the target toner weight, the potential controller 604 drives the respective units on the basis of the control parameters according to the gradation values included in the image data and the sheet type signal. These control parameters are previously stored in a not-illustrated memory of the potential controller 604, with the control parameters related, to identification information representing the type of the recording sheet.

Further, the potential controller 604 outputs the linage selection, signal to the signal selector 603 when, the difference between the actual value and the ideal value of each of the exposure, the charge potential, and the potential of the development bias described above exceeds a threshold. The above-described difference is increased when the drive state of each of the laser driver 510, the charger power supply 511, and the development bias power supply 512 is different from the ideal drive state.

When a patch image formed on the recording sheet by the image forming unit 50 is read by the image reading unit 20, the potential parameter determining unit 605 acquires the read, signal representing the reading result, and outputs the control parameters determined on the basis of the read signal to the potential controller 604, with the control parameters related to the sheet type signal. The function and operation of the potential parameter determining unit 605 will be described in detail later.

The development controller 606 has a function of, upon formation of the toner image according to the patch image signal, feeding the density of the toner image detected by the toner density sensor 508 back to the toner supply amount of the developing device 505. Specifically, the development controller 606 adds up dot count values supplied by the dot counter 601, and outputs the image selection signal to the signal selector 603 if the sum of the dot count values exceeds a predetermined threshold. The threshold is set on the basis of the number of (30, for example) dots determined in accordance with the number of output sheets requiring calibration of the toner supply amount of the developing device 505. That is, the image selection signal is output at a time when at least a predetermined number of image forming processes have been performed and it is considered desirable to reset the optimal toner supply amount.

When the signal selector 603 having acquired the image selection signal outputs the patch image signal to the image forming unit 50, rectangular toner images having different densities according to the patch image signal are sequentially formed on the photoconductor drum 501 by the image forming unit 50. Then, the density of each of the formed toner images is read by the toner density sensor 508 and supplied to the development controller 606 as the toner density signal. The development controller 606 calculates the difference between the actual value of the density at the density detection point and the ideal value of the density stored in a memory of the development controller 606 on the basis of the toner density signals sequentially supplied by the toner density sensor 508, and determines whether or not the difference falls within a preset allowable range. Then, if it is determined that the difference exceeds the allowable range, the development controller 606 thereafter outputs to the developing device 505 a toner supply control signal for offsetting the difference when forming the toner image according to the image signal input by the image input unit 30, to thereby increase or reduce the toner amount to be supplied to the developing device 505 from a toner cartridge. For example, if the actual value of the density at the density detection point fails below a lower limit of the allowable range, the development controller 606 supplies a toner supply control signal for instructing to increase the toner supply amount. If the no actual value of the density at the density detection point exceeds the allowable range, the development controller 606 supplies a toner supply control signal for instructing to reduce the toner supply amount.

The transfer controller 607 supplies a first transfer current control signal according to the sheet type signal to the first transfer device 506 to control the first transfer current flowing through the first transfer device 506. Herein, the magnitude of the first transfer current controlled by the transfer controller 607 is preset as related to the identification information representing the type of the recording sheet. It is thereby possible to control the toner weight of the toner to be transferred to the intermediate transfer belt 55 from the photoconductor drum 501. Specifically, the surface potential of the photoconductor drum 501 and the transfer potential of the first transfer device 506 are opposite to each other in polarity. Further, in accordance with a reduction of the first transfer current value, the electrostatic force generated between the photoconductor drum 501 and the first transfer device 506 is reduced, and thus the toner weight to be transferred is reduced (the transfer rate is reduced). Meanwhile, in accordance with an increase of the first transfer current, the potential difference between the photoconductor drum 501 and the first transfer device 506 is increased, and the toner weight of the toner to be transferred to the intermediate transfer belt 55 is increased (the transfer rate is increased).

The fixing controller 608 outputs to the fixing device 57 a fixing control signal for controlling the fixing temperature, fixing speed, and fixing pressure on the basis of the sheet type signal and a fixing roller temperature acquired from the temperature sensor 513. The control parameters corresponding to the fixing control signal are preset to increase the fixing temperature, reduce the fixing speed, and increase the fixing pressure in the case of a thick recording sheet, for example. The fixing controller 608 may also control the control parameters for fixing conditions in accordance with the toner weight.

The process controller 60 thus outputs the control parameters according to the type and characteristics of the sheet to the image forming unit 50 to control the toner weight of the toner image to be formed on the recording sheet.

The overall configuration of the image forming apparatus 100 is as described above. A detailed, description will now be given of processes and functions realized by the image forming apparatus 100. In the following description, the reference numerals in FIGS. 1 and 2 will be used to designate the configurations (parts) illustrated in FIGS. 1 and 2.

In the image forming apparatus 100 in FIG. 1, the process controller 60 controls the image forming unit 50 such that, in the formation of an image on each medium of plural media (recording sheets) different in reflectance, the metallic toner has a toner weight according to the medium. For example, the process controller 60 controls the image forming unit 50 such that the toner weight of the metallic toner is greater on a medium lower in reflectance than a medium having a reference reflectance than on the medium having the reference reflectance.

Figure 3A:
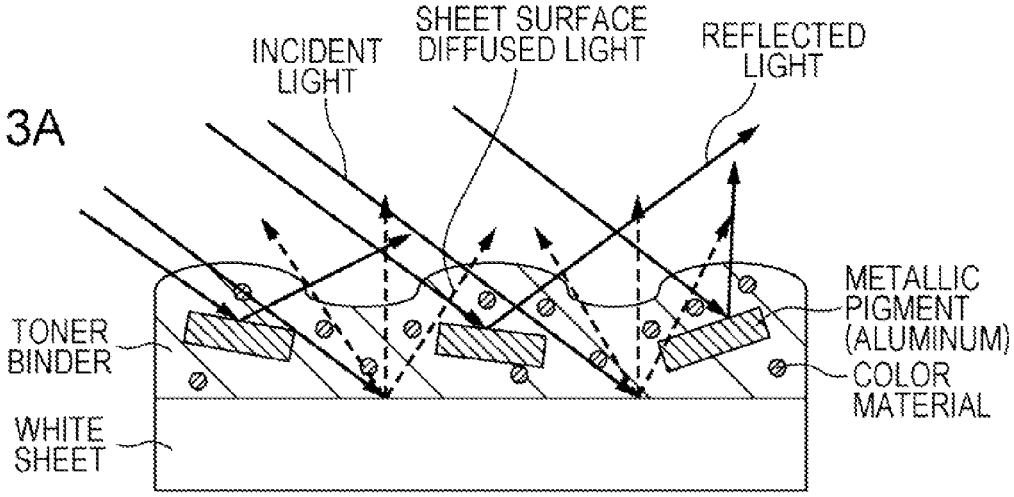
FIGS. 3A to 3C are diagrams for illustrating behaviors of incident light on recording sheets.
Figure 3B:
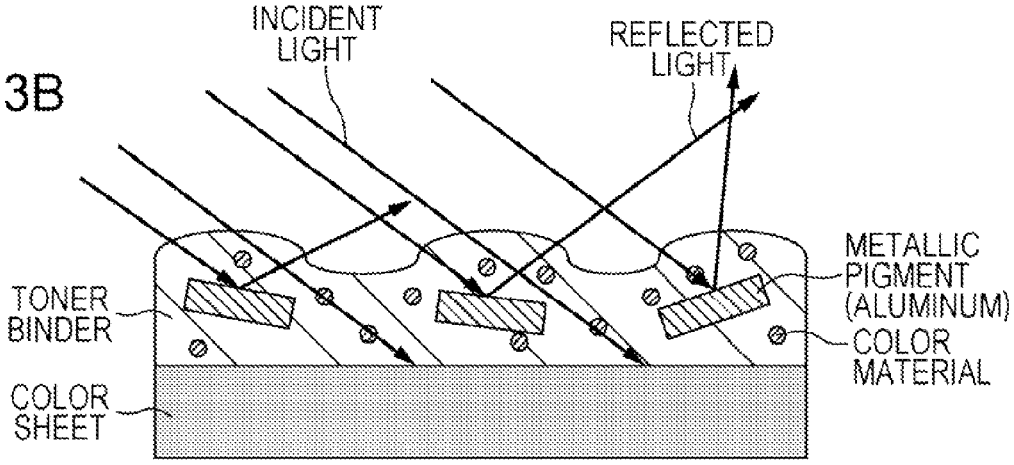
Figure 3C:
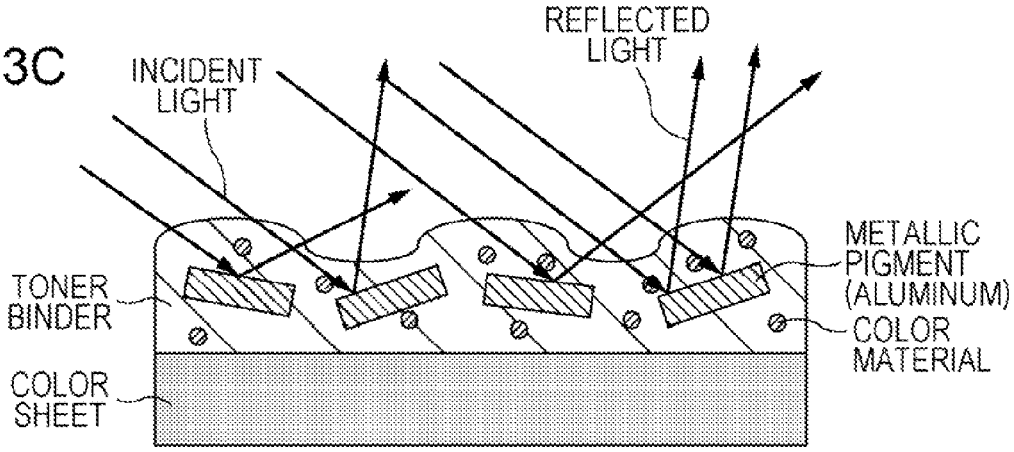

FIGS. 3A to 3C are diagrams for illustrating behaviors of incident light on recording sheets. FIGS. 3A to 3C each illustrate a cross-sectional structure of a recording sheet (a white sheet or a color sheet) and a toner binder transferred to and fixed on the sheet.

FIG. 3A illustrates the state of a toner transferred to and fixed on a white sheet, and FIG. 3B illustrates the state of a toner transferred to and fixed on a color sheet. The total toner amount of the C, M, Y, and K color toners and the toner amount of the metallic toner are the same between FIG. 3A and FIG. 3B.

Sufficient color reproducibility may not be obtained with the color shoes illustrated, in FIG. 3B as compared with the white sheet in FIG. 3A. This is considered to be because sufficient color reproducibility is obtainable with the whine sheet having a high reflectance even if the toner amount of the metallic toner is small, since the incident light is diffusedly reflected by the sheet (sheet surface diffused light), while the incident light is absorbed by the color sheet having a low reflectance if the toner amount of the metallic toner is small.

Therefore, the process controller 60 controls the image forming unit 50 such that the toner weight of the metallic toner is greater on the color sheet lower in reflectance than the white sheet having a reference reflectance than on the white sheet having the reference reflectance.

FIG. 3C illustrates a toner state in which the toner weight of the metallic toner on the color sheet is increased. The toner weight of the metallic toner is greater (larger) and the amount of a metallic pigment of the metallic toner (aluminum powder, for example) is greater in FIG. 3C than in FIG. 3B. As compared with FIG. 3B, therefore, the light-reflected by the metallic pigment is increased, and the incident light absorbed by the color sheet is reduced. Thereby, metallic luster and color reproducibility are improved.

The process controller 60 thus controls the image forming unit 50 such that the toner weight of the metallic toner is greater on a medium lower in reflectance than a medium having a reference reflectance (a color sheet, for example) than on the medium having the reference reflectance (a white sheet, for example). Specifically, for example, the target color reproducibility is set on the basis of the image formed, on the medium having the reference reflectance, and the process controller 60 controls the toner weight of the metallic toner such that the target color reproducibility is realized in the image formed with the metallic toner on the medium lower in reflectance than the medium having the reference reflectance.

Figure 4:
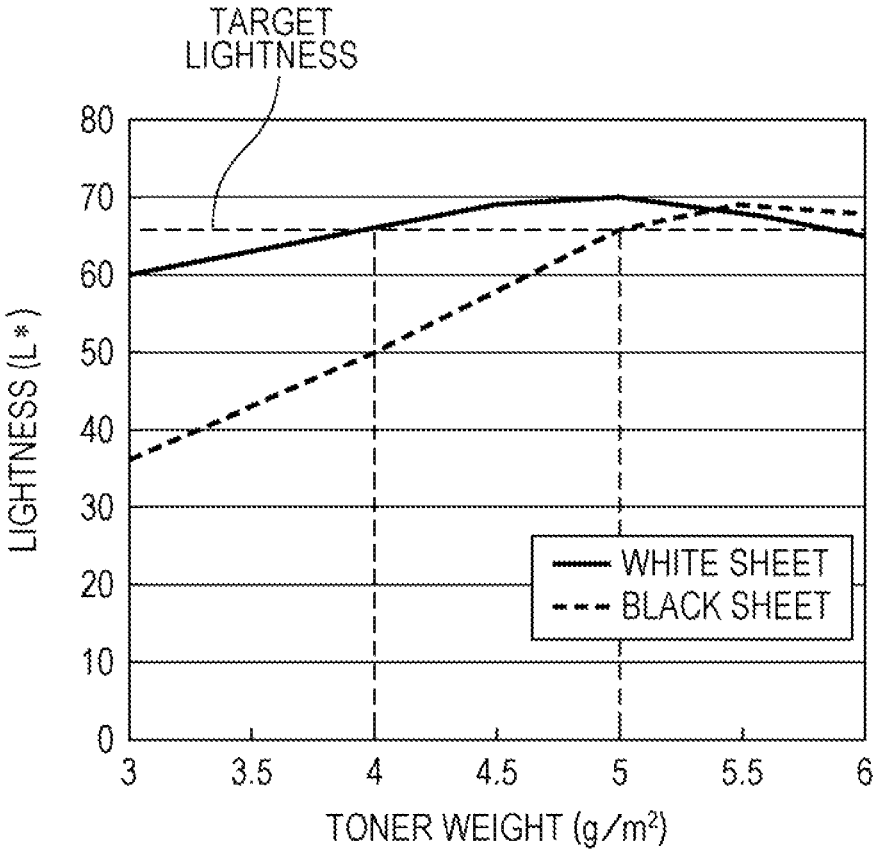
FIG. 4 is a diagram illustrating the relationship between the toner weight and the color reproducibility.

FIG. 4 is a diagram illustrating the relationship between, the toner weight and the color reproducibility. In FIG. 4, the horizontal axis represents the toner weight of the metallic toner, and the vertical axis represents the measurement result of the color reproducibility (lightness) of the image. It is possible to evaluate the color reproducibility of the image on the basis of the lightness or density of the image, for example. In FIG. 4, the color reproducibility is evaluated on the basis of the lightness.

FIG. 4 illustrates a line graph corresponding to the white sheet having the reference reflectance (a solid line) and a line graph corresponding to the black sheet having a particularly low reflectance (a broken line). Each of the graphs corresponding to the white sheet and the black sheet illustrated in FIG. 4 indicates correlation between the toner weight of the silver toner and the measurement value of the lightness in an image having an area ratio of 100% (a so-called solid image) and formed only with the silver toner (not including the C, M, Y, and K toners).

As to the white sheet, when the toner weight of the metallic toner (silver toner) ranges from approximately 3 $g/m^2$ to approximately 5 $g/m^2$, the lightness increases, i.e., the color reproducibility improves in accordance with a rise (increase) of the toner weight. Meanwhile, the orientation of the metallic pigment contained in the metallic toner tends to deteriorate in accordance with the increase of the toner weight of the metallic toner on the white sheet, and thus sufficient metallic luster may not be obtained. That is, sufficient metallic luster may not foe obtained by simply improving only the color reproducibility.

In the present exemplary embodiment, therefore, the toner weight of the metallic toner on the white sheet is determined with both the color reproducibility (lightness) and the metallic luster taken, into account. For example, images are formed on the white sheet with different toner weights of the metallic toner, and the metallic luster of each of the images is measured. Then, the toner weight for obtaining desired metallic luster, such as the maximum metallic luster, for example, is determined. Thereby, the toner weight of the metallic toner fox the white sheet is determined to be 4 g/m$^2$, for example, as illustrated in FIG. 4. Further, the color reproducibility realized on the white sheet by the determined toner weight is set to be the target color reproducibility on another color sheet. For example, the lightness corresponding to the toner weight of 4 g/m$^2$ on the white sheet is set to be the target lightness. In the example illustrated in FIG. 4, the target lightness is set to approximately 68 (L*).

Then, the toner weight of the metallic toner for realizing the target lightness is determined for the black sheet lower in reflectance than the white sheet. As illustrated in FIG. 4, the lightness is lower on the black sheet than on the white sheet when the toner weight of the metallic toner ranges from approximately 3 g/m$^2$ to approximately 5 g/m$^2$. Therefore, if an image is formed on the black sheet with the toner weight determined for the white sheet (4 g/m$^2$, for example), for example, the lightness on the black sheet is approximately 50 (L*), not realizing the target lightness. In the case of the black, sheet, therefore, the toner weight is increased as compared, with the case of the white sheet, and the toner weight of the metallic toner is determined to be 5 g/m$^2$ for example. Thereby, a target lightness of approximately 68 (L*) is also realized on the black sheet.

Figure 5A:
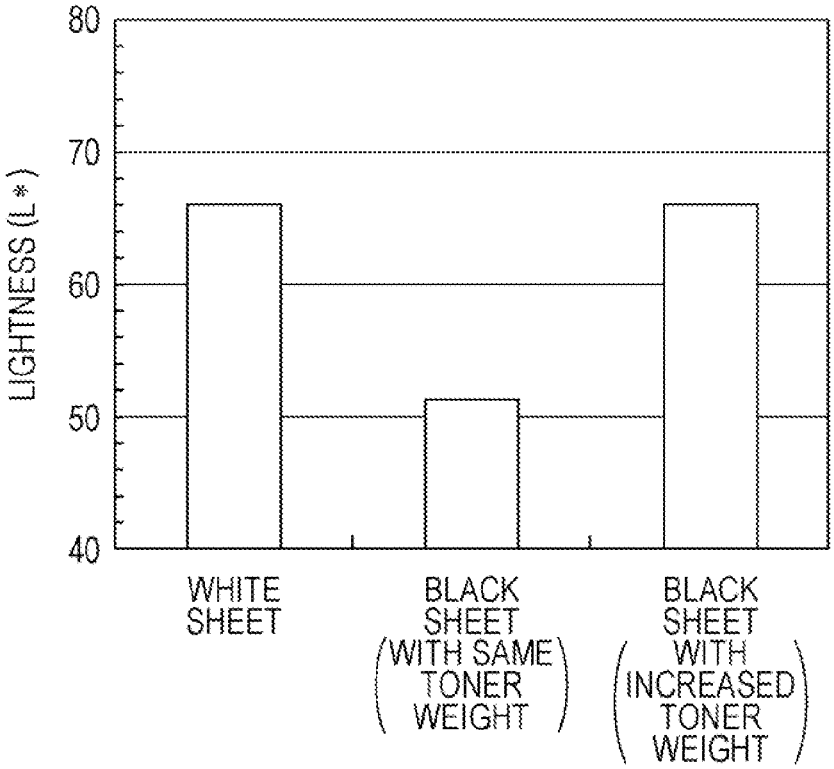
FIGS. 5A and 5B are diagrams for illustrating effects of an increase of the toner weight.
Figure 5B:
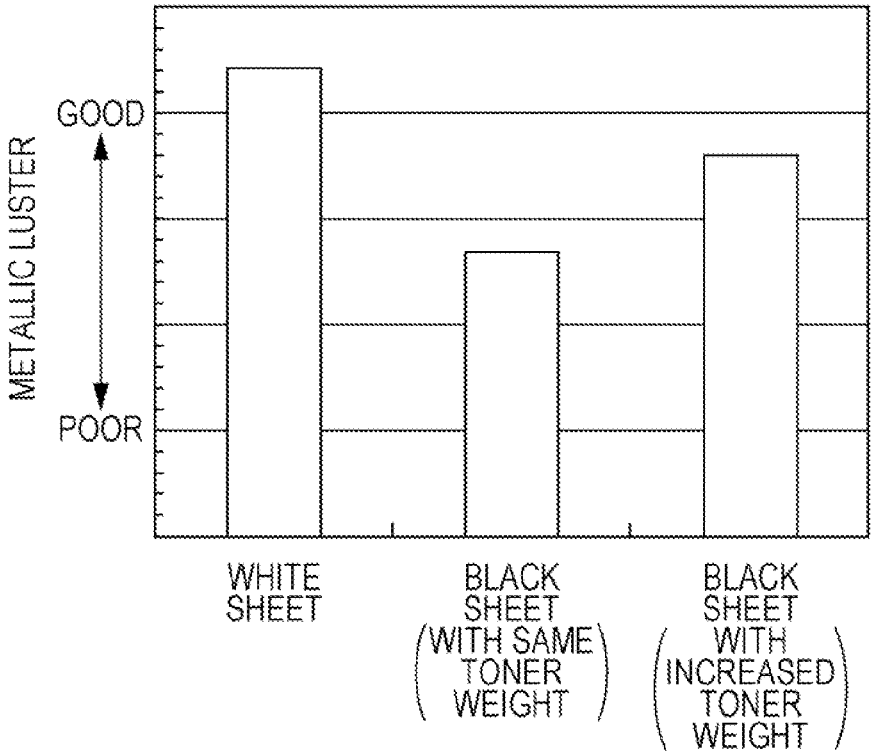

FIGS. 5A and 5B are diagrams for illustrating effects of the increase of the toner weight. FIG. 5A is a graph of the color reproducibility (lightness), and FIG. 5B is a graph of the metallic luster.

The toner weight of the metallic toner for the white sheet is determined with both the color reproducibility (lightness) and the metallic luster taken into account, as already described (see FIG. 4). Therefore, the toner weight of the metallic toner for the white sheet is set to be 4 g/m$^2$, for example. If an image is formed on the white sheet with this toner weight, the lightness on the white sheet is approximately 68 (L*), as illustrated in FIG. 5A, and substantially favorable metallic luster is obtained on the white sheet, as illustrated in FIG. 5B.

Meanwhile, if an image is formed on the black sheet with the same toner weight as the toner weight determined for the white sheet (4 g/m$^2$, for example), the lightness on the black sheet (with the same toner weight) is approximately 51 (L*) lower than the lightness on the white sheet, as illustrated in FIG. 5A. Further, the metallic luster on the black sheet (with the same toner weight) is worse than the metallic luster on the white sheet, as illustrated in FIG. 5B.

If an image is formed with the toner weight of the metallic toner on the black sheet increased (5 g/m$^2$, for example), therefore, the lightness on the black sheet (with the increased toner weight) is improved up to approximately 68 (L*), which is the same as the lightness on the white sheet, as illustrated in FIG. 5A. Further, as illustrated in FIG. 5B, when compared with the black sheet with the toner weight not increased (with the same toner weight), the metallic luster is improved on the black sheet with the toner weight increased (with the increased toner weight).

With the toner weight of the metallic toner thus increased to realize the target color reproducibility on the black sheet, the metallic luster is improved as well as the color reproducibility.

Also in the case of a color sheet other than the black, sheet, i.e., a color sheet different in reflectance from the black sheet, the toner weight of the metallic toner may be increased by the method described with reference to FIG. 4, for example, to realize the target lightness determined for the white sheet (68 (L*), for example). Further, the reflectance of a color sheet other than the black sheet is generally lower than the reflectance of the white sheet and higher than the reflectance of the black sheet. Therefore, the toner weight of the metallic toner for the color sheet other than the black sheet may be set to be greater than the toner weight of the metallic toner for the white sheet (4 g/m$^2$, for example) and less than the toner weight of the metallic toner for the black sheet (5 g/m$^2$, for example), such as an intermediate value between the value for the whine sheet and the value for the black sheet (4.5 g/m$^2$), for example.

Further, the user may specify the color of each medium (recording sheet), and the toner weight of the metallic toner may be set in accordance with the color specified by the user (the color of one of "white sheet," "black sheet," and "color sheet," for example) in the formation of the image on the medium. The user may, of course, set the toner weight of the metallic toner according to each medium (each recording sheet).

Further, the image reading unit 20 may measure the reflectance of each medium (recording sheet), and the toner weight of the metallic toner may be set in accordance with the level (magnitude) of the measured reflectance such that the toner weight of the metallic toner increases in accordance with a reduction in reflectance of the medium. Further, for example, a reflectance sensor or a colorimetric sensor may be provided, to the sheet feed tray 51 to measure the reflectance or color of the recording sheets stored in the sheet feed tray 51 and determine the toner weight of the metallic toner corresponding to the recording sheets in accordance with the measurement result. An inline sensor for measuring the sheet subjected to the fixing process may be used to measure the reflectance or color of the sheet. That is, the recording sheet may be sent to the fixing process with no image formed thereon, and the reflectance or color of the recording sheet may foe measured by the inline sensor.

Further, as described in detail below, the toner weight of the metallic toner for each medium (each recording sheet) may be optimized with the use of a test image.

Figure 6:
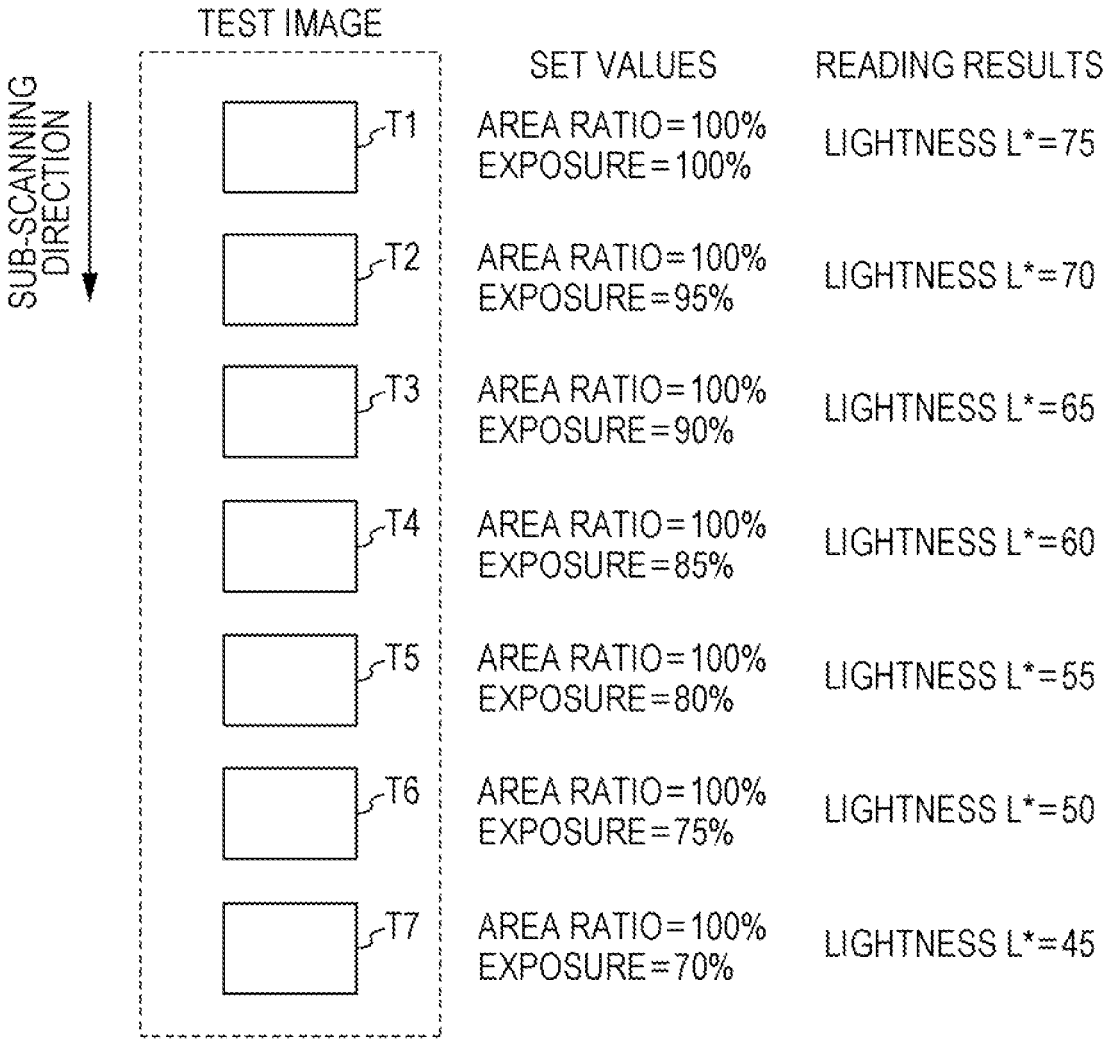
FIG. 6 is a diagram for illustrating a specific example of optimization using a test image.

FIG. 6 is a diagram for illustrating a specific example of optimization using the test image. The test image includes plural partial images T1 to T7 formed with different toner weights of the metallic toner.

Set values are parameters used to form the plural partial images T1 to T7. The plural partial images T1 to T7 are images having an area ratio of 100% (so-called solid images) and formed only with the metallic toner (not including the C, M, Y, and K toners). The toner weight of the metallic toner is adjusted for each of the partial images T1 to T7 in accordance with the exposure value. That is, the exposure is maximized to 100% in the partial, image T1, and the toner weight is maximized in the partial image T1. Further, the exposure is gradually reduced in the order of the partial images T2, T3, T4, and so forth, and the toner weight is also gradually reduced. The exposure is minimized to 70% in the partial image T7, and the toner weight is minimized in the partial image T7.

For example, if the user issues an instruction to set the control parameters for the recording sheet by using the UI unit 40 when the reflectance and so forth of the recording sheet are unknown, the selector 12 acquires the test image signal from the test image signal generating circuit 11 and supplies the test image signal to the image forming unit 50. The image forming unit 50 forms the image according to the acquired test image signal on a recording sheet as an evaluation target, which is provided by the user or stored in the sheet feed tray 51. Herein, the partial images T1 to T7 in the test image enclosed by a broken line in FIG. 6 are sequentially formed on the recording sheet along the sub-scanning direction. Further, in the formation of the partial images T1 to T7, the image forming unit 50 forms electrostatic latent images by gradually changing the exposure for each of the partial images T1 to T7.

The patch signal generating unit 602 may generate the test image signal of the test image illustrated in FIG. 6 as the patch image signal.

Subsequently, the user places the recording sheet formed with the partial images T1 to T7 on the image reading unit 20, and instructs the image reading unit 20 to read the partial images T1 to T7 via the UI unit 40. In accordance with the instruction, the image reading unit 20 reads the images on the recording sheet (the partial images T1 to T7), and generates an image signal (read signal) representing the reading result. For example, as illustrated, in FIG. 6, the lightness of each of the partial images T1 to T7 is obtained as the reading result and displayed on the UI unit 40 or the like having a display function. Then, the user selects a desired lightness from the reading results displayed on the UI unit 40 or the like. Thereby, an exposure according to the desired lightness is determined, and the process controller 60 controls the image forming unit 50 to use the exposure when forming an image on the recording sheet as the evaluation target or a recording sheet of the same type (a similar level of reflectance) as the recording sheet as the evaluation target.

Further, for example, the desired lightness may previously be determined, and the process controller 60 may determine the exposure according to the desired lightness on the basis of the reading results of the images on the recording sheet (the partial images T1 to T7) read by the image reading unit 20.

According to the above-described specific example of optimization, it is possible to optimize the toner weight of the metallic toner according to the recording sheet when the reflectance of the recording sheet is unknown, for example. In the above-described specific example, the toner weight of the metallic toner is controlled on the basis of the exposure. However, it is possible to control the toner weight of the metallic toner to be transferred to the recording sheet by controlling at least one of the exposure, the charge potential, the development bias, and the transfer potential. Further, if only the first transfer current is changed, for example, an amount of toner according to the value of the first transfer current is transferred to the intermediate transfer belt 55. It is therefore possible to change the toner weight of the metallic toner to be superimposed on the recording sheet.

Further, the transfer or fixing may be controlled in accordance with the toner weight of the metallic toner. For example, since the toner weight of the metallic toner is set to be greater on a color sheet having a low reflectance than on the white sheet, it is more difficult to perform the fixing on the color sheet, than on the white sheet. In the case of the color sheet having a low reflectance, therefore, the fixing temperature or the fixing pressure may be increased or the fixing speed may be reduced as compared with the case of the white sheet.

The image forming apparatus 100 in the exemplary embodiment of the present invention is configured as described above. Parts or all of the functions of the process controller 60 may be realized by a computer. In that case, a program (a control program of the image forming unit 50) corresponding to the above-described parts or all of the functions is stored in a computer readable storage medium, such as a disc or a memory, for example, and is provided to the computer via the storage medium. The program may, of course, be provided to the computer via a communication line, such as the Internet. Further, the parts or all of the functions of the process controller 60 are realized by the cooperation of hardware resources included in the computer, such as a central processing unit (CPU) and a memory, and the provided program (software).

The foregoing description of the exemplary embodiment of the present invention has been provided for the purposes of illustration and description. It is not intended to be exhaustive or to limit the invention to the precise forms disclosed. Obviously, many modifications and variations will foe apparent to practitioners skilled in the art. The embodiment was chosen and described in order to best explain the principles of the invention, and its practical applications, thereby enabling others skilled in the art to understand the invention for various embodiments and with, the various modifications as are suited to the particular use contemplated. It is intended that the scope of the invention be defined by the following claims and their equivalents.

What is claimed is:

1. An image forming apparatus comprising:

an image forming unit that forms an image on a medium with a metallic toner that comprises a powder of a metal; and a controller that controls the image forming unit such that, in the formation of an image on each medium of a plurality of media different in reflectance, the metallic toner has a toner weight according to the medium, wherein the controller controls the image forming unit such that the toner weight of the metallic toner is greater on a medium lower in reflectance than a medium having a reference reflectance than on the medium having the reference reflectance.

2. The image forming apparatus according to claim 1, wherein target color reproducibility is set on the basis of an image formed on a medium having a reference reflectance, and wherein the controller controls the toner weight of the metallic toner to realize the target color reproducibility in an image formed with the metallic toner on a medium lower in reflectance than the medium having the reference reflectance.

3. The image forming apparatus according to claim 2, wherein the controller controls the image forming unit such that the toner weight of the metallic toner increases in accordance with a reduction in reflectance of the medium.

4. The image forming apparatus according to claim 2, further comprising:

an image signal generating unit that generates an image signal of a test image including a plurality of partial images formed with different toner weights of the metallic toner; and an image reading unit that reads an image formed on each medium, wherein the image forming unit forms the test image on an evaluation medium as an evaluation target with the metallic toner on the basis of the image signal, wherein the image reading unit reads the test image formed on the evaluation medium, wherein, on the basis of a result of reading by the image reading unit, color reproducibility of each of the partial images formed with the different toner weights is evaluated in the test image formed on the evaluation medium, and a toner weight according to desired color reproducibility is determined, and wherein the controller controls the image forming unit such that, in the formation of an image on a medium substantially the same in reflectance as the evaluation medium, the metallic toner has a toner weight according to the desired color reproducibility.

5. The image forming apparatus according to claim 3, further comprising:

an image signal generating unit that generates an image signal of a test image including a plurality of partial images formed with different toner weights of the metallic toner; and an image reading unit that reads an image formed on each medium, wherein the image forming unit forms the test image on an evaluation medium as an evaluation target with the metallic toner on the basis of the image signal, wherein the image reading unit reads the test image formed on the evaluation medium, wherein, on the basis of a result of reading by the image reading unit, color reproducibility of each of the partial images formed with the different toner weights is evaluated in the test image formed on the evaluation medium, and a toner weight according to desired color reproducibility is determined, and wherein the controller controls the image forming unit such that, in the formation of an image on a medium substantially the same in reflectance as the evaluation medium, the metallic toner has a toner weight according to the desired color reproducibility.

6. The image forming apparatus according to claim 1, wherein the controller controls the image forming unit such that the toner weight of the metallic toner increases in accordance with a reduction in reflectance of the medium.

7. The image forming apparatus according to claim 6, further comprising:

an image signal generating unit that generates an image signal of a test image including a plurality of partial images formed with different toner weights of the metallic toner; and an image reading unit that reads an image formed on each medium, wherein the image forming unit forms the test image on an evaluation medium as an evaluation target with the metallic toner on the basis of the image signal, wherein the image reading unit reads the test image formed on the evaluation medium, wherein, on the basis of a result of reading by the image reading unit, color reproducibility of each of the partial images formed with the different toner weights is evaluated in the test image formed on the evaluation medium, and a toner weight according to desired color reproducibility is determined, and wherein the controller controls the image forming unit such that, in the formation of an image on a medium substantially the same in reflectance as the evaluation medium, the metallic toner has a toner weight according to the desired color reproducibility.

8. The image forming apparatus according to claim 1, further comprising:

an image signal generating unit that generates an image signal of a test image including a plurality of partial images formed with different toner weights of the metallic toner; and an image reading unit that reads an image formed on a medium, wherein the image forming unit forms the test image on an evaluation medium as an evaluation target with the metallic toner on the basis of the image signal, wherein the image reading unit reads the test image formed on the evaluation medium, wherein, on the basis of a result of reading by the image reading unit, color reproducibility of each of the partial images formed with the different toner weights is evaluated in the test image formed on the evaluation medium, and a toner weight according to desired color reproducibility is determined, and wherein the controller controls the image forming unit such that, in the formation of an image on a medium substantially the same in reflectance as the evaluation medium, the metallic toner has a toner weight according to the desired color reproducibility.

9. The image forming apparatus according to claim 1, further comprising:

an image signal generating unit that generates an image signal of a test image including a plurality of partial images formed with different toner weights of the metallic toner; and an image reading unit that reads an image formed on each medium, wherein the image forming unit forms the test image on an evaluation medium as an evaluation target with the metallic toner on the basis of the image signal, wherein the image reading unit reads the test image formed on the evaluation medium, wherein, on the basis of a result of reading by the image reading unit, color reproducibility of each of the partial images formed with the different toner weights is evaluated in the test image formed on the evaluation medium, and a toner weight according to desired color reproducibility is determined, and wherein the controller controls the image forming unit such that, in the formation of an image on a medium substantially the same in reflectance as the evaluation medium, the metallic toner has a toner weight according to the desired color reproducibility.

10. A non-transitory computer readable medium storing a program causing a computer, which controls an image forming unit that forms an image on a medium with a metallic toner that comprises a powder of a metal, to execute a process for image formation, the process comprising:

controlling the image forming unit such that, in the formation of an image on a medium of a plurality of media different in reflectance, the metallic toner has a toner weight according to the medium, wherein the image forming unit is controlled such that the toner weight of the metallic toner is greater on a medium lower in reflectance than a medium having a reference reflectance than on the medium having the reference reflectance.

11. An image forming method comprising:

forming an image on a medium with a metallic toner that comprises a powder of a metal; and controlling image formation such that, in the formation of an image on each medium of a plurality of media different in reflectance, the metallic toner has a toner weight according to the medium, wherein the controlling image formation is such that the toner weight of the metallic toner is greater on a medium lower in reflectance than a medium having a reference reflectance than on the medium having the reference reflectance.

* * * * *